United States Patent [19]

Hagemeister

[11] Patent Number: 4,586,564

[45] Date of Patent: May 6, 1986

[54] GUIDE WALL OF A HEAT EXCHANGER FOR COVERING THE U-SHAPED PORTIONS OF A TUBE ASSEMBLY

[75] Inventor: Klaus Hagemeister, Munich, Fed. Rep. of Germany

[73] Assignee: Motoren-und Turbinen-Union Munchen GmbH, Munich, Fed. Rep. of Germany

[21] Appl. No.: 677,190

[22] Filed: Dec. 3, 1984

[30] Foreign Application Priority Data

Jan. 18, 1984 [DE] Fed. Rep. of Germany ..... 3401536

[51] Int. Cl.[4] ..... F28D 7/06

[52] U.S. Cl. ..... 165/159; 165/81

[58] Field of Search ..... 165/159, 160, 81

[56] References Cited

U.S. PATENT DOCUMENTS

| | | | |
|---|---|---|---|
| 2,110,024 | 3/1938 | Miller | 165/159 |
| 3,112,793 | 12/1963 | Sass | 165/172 |
| 3,746,083 | 7/1973 | Tieferbacher | 165/159 X |
| 4,296,539 | 10/1981 | Asami | 165/133 X |
| 4,325,171 | 4/1982 | Nobles | 165/159 X |

FOREIGN PATENT DOCUMENTS

| | | | |
|---|---|---|---|
| 2000886 | 7/1971 | Fed. Rep. of Germany | 165/159 |
| 162400 | 12/1981 | Japan | 165/159 |
| 531994 | 2/1977 | U.S.S.R. | 165/159 |

*Primary Examiner*—Albert W. Davis, Jr.
*Assistant Examiner*—Peggy A. Neils
*Attorney, Agent, or Firm*—Roberts, Spiecens & Cohen

[57] ABSTRACT

A heat exchanger comprising an assembly of spaced heat exchanger tubes of U-shape having inlet ends for receiving an operating fluid and outlet ends for discharge of the fluid, the fluid flowing through the tubes and undergoing flow reversal in the U-shaped portions. The tube assembly is mounted in a housing having an inlet for a second fluid for flow across the tube assembly to undergo heat exchange with the fluid flowing in the tubes and an outlet for discharge of the second fluid. The housing has an opening in which the U-shaped portions of the tubes extend for free displacement relative to the housing. A guide wall surrounds the tubes at the U-shaped portions and is connected to the housing to cover the opening therein. The guide wall is shaped to conform to the U-shaped portions of the assembly and rests on the outer tubes of the tube assembly in floating relation. At its opposite ends the guide wall is engaged with the housing so as to be relatively movable and follow the movements of the tubes on which it rests such that the assembly is freely movable relative to the housing and the tubes are relatively movable with respect to one another.

25 Claims, 19 Drawing Figures

FIG. 16
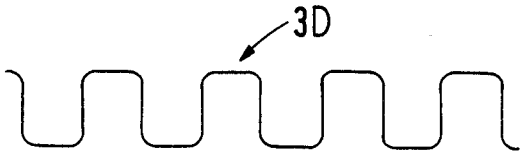
FIG. 17
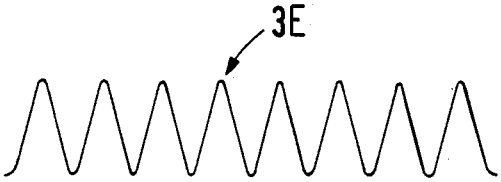
FIG. 18
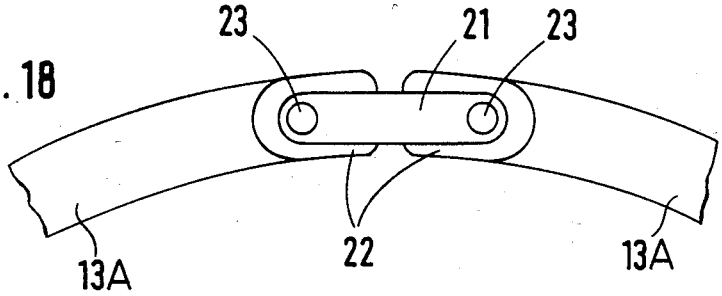
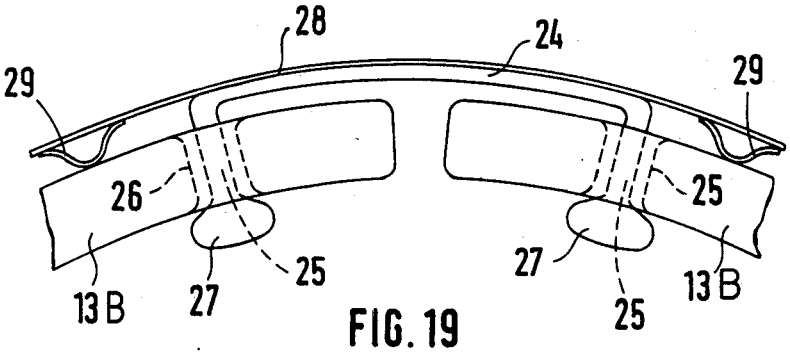
FIG. 19

GUIDE WALL OF A HEAT EXCHANGER FOR COVERING THE U-SHAPED PORTIONS OF A TUBE ASSEMBLY

FIELD OF THE INVENTION

The invention relates to a heat exchanger of the type comprising an assembly or matrix of spaced heat exchanger tubes of U-shape having inlet ends connected to a first duct for the supply of an operating fluid, such as compressed air, to the heat exchangetubes and outlet ends connected to a second duct for discharge of heated operating fluid from the heat exchange tubes. A heated gas flows, in a housing containing the tubes, in a direction across the tubes to contact the outer surfaces thereof to heat the operating fluid flowing within the tubes. The first and second ducts extend substantially parallel to one another and are connected to straight legs of the U-shaped heat exchange tubes and the curved, U-portions of the tubes serve as flow reversal regions for the operating fluid flowing within the tubes. The U-portion of the tubes is surrounded by a limiting guide wall which is connected to the housing.

BACKGROUND

In tubular heat exchangers, it is necessary to provide the limiting guide wall around the curved portion of the U-shaped tubes. Heretofore, the limiting guide walls have been constructed, for instance, as sheet-metal wings which conform to the arcuate outer contour of the curved portions of the tubes. The limiting wall is integral with or secured as a separate element to the housing. The temperature and, consequently, the expansion of the wall differs from that of the tube assembly. Therefore, in order to permit free displaceability of the tube assembly, a gap or spacing is required between the guide wall and the adjacent curved portions of the tubes of the assembly.

Such a spacing results in a relatively large leakage flow for the fluid which is external of the heat exchanger tubes, namely the heated gas.

As a result of this construction, two important disadvantages result which reduce the effectiveness of the heat exchanger:

First, this quantity of hot leakage gas does not participate in the heat exchange process and, second, it "shoots" , at the outlet of the gap, at a relatively high velocity into the normal region of discharge of the heated gas downstream of the tube assembly to produce turbulence in this downstream region and, thus, also relatively intense non-uniformity in flow which, together with the first disadvantage, leads to a relatively large reduction in the degree of heat exchange.

U.S. Pat. No. 3,746,083 discloses a heat exchanger of the above type in which the limiting guide wall conforms to the curved portion of the tubes in spaced relation therewith and is a fixed part of the housing which receives the tube assembly and guides the hot gases. The guide wall directly rests against the curved portions of the tubes of the assembly through the intermediary of pressure elements which bridge the gap between the limiting guide wall and the curved portions of the tubes. Thereby, the leakage flow gap is substantially sealed off, with the consequence, however, of a non-definable heat-exchange process in the region of the curved portions of the outer tubes of the assembly. Namely, a flow of hot gases guided uniformly around the curved portions and the outer tubes of the assembly is not effected. In particular, thermally produced differential expansions between the tubes and the housing and/or the outer limiting guide wall which are produced particularly, in the curved region of the tubes are not taken into consideration in this construction.

SUMMARY OF THE INVENTION

An object of the invention is to provide a construction of a heat exchanger which eliminates the disadvantages noted above.

A further object of the invention is to provide a heat exchanger in which the outer wall surrounding the U-shaped portion of the tube assembly is constructed to take into account the unavoidable differences in expansion between the individual tubes as well as between the tubes and the surrounding structure.

Yet another object of the invention is to provide a heat exchanger in which the U-shaped portion of the tube assembly can be substantially included in the heat exchange process without adversely affecting the uniformity of the fluid flow at the discharge region of the housing.

In accordance with the above and further objects of the invention, the guide wall is constructed as a separate element which surrounds the tubes at the U-shaped portions thereof and is connected to the housing in order to cover an opening into which the U-shaped portions of the tube extend for free-displacement relative to the housing.

In further accordance with the invention, the heat exchanger comprises means supporting the guide wall of the tube assembly in floating relation and means supporting the guide wall, at opposite ends thereof, on the housing for relative movement such that the guide wall permits free movement of the tube assembly relative to the housing and relative movement of said tubes with respect to one another.

According to one embodiment of the invention, the limiting guide wall is formed as a single element of corrugated shape which conforms to the U-shaped portions of the tubes. The spacing of the corrugations corresponds to the spacing between adjacent tubes, so that, upon positioning of the guide wall, the valleys of the corrugations extend into the spaces between the adjacent tubes. In this way, the heated gases can flow efficiently in the heat-exchange process.

In this embodiment, the guide wall serves as a cover plate for the U-shaped portions of the tubes and rests on the tubes. The points of contact are distributed at random when the guide wall extends as a single element over the entire assembly. The contact takes place on a few tubes, depending on which individual tube protrudes from the assembly of the other tubes in the radial direction towards the guide wall as a result of tolerances or thermal expansion. The tubes which the guide wall contacts may also change during operation depending, on how the tubes individually expand under heat. In such case, the guide wall "floats" on the edges of the tubes of the assembly i.e. it assumes a spatial position which varies in time according to the integral mean value of the positions of the tubes. In order for the limiting guide wall to follow the movements of the tubes, the guide wall is resiliently or adjustably supported with respect to the housing. This is achieved by engagement of the ends of the guide wall in displaceable manner with the housing, particularly by interengagement of finger-like extensions on both the housing and the ends of the guide wall.

In further accordance with the invention, the guide wall can be divided into individual, for example arcuate, guide wall sections which are of V or U shape in cross-section and are formed, for example, for each tube, of two sheets of strip metal which, in turn, are of S shape. The guide wall sections "ride" individually on the respective tubes. The guide wall sections of adjacent tubes contact each other laterally and thus close off the area to be covered, but they are movable individually with respect to each other and individually follow the individual movements of the tubes on which they "ride". In this embodiment also, the ends of the guide wall can be interengaged with the housing by means of finger-like interengagement to obtain the "floating" function of the guide wall.

As a result of manufacturing tolerances and warping in operation, contact takes place between the adjacent surfaces of the limiting guide wall and the tubes. The abrasive movements inherent therein could, during the course of the operating life of the heat exchanger, lead to leaks in the tubes as a result of wear of material.

Therefore, in further accordance with the invention, irrespective of whether the limiting guide wall is made as a single element or several guide wall sections or corrugated or non-corrugated, the U-shaped portions of the tubes are encircled with straps which contact the guide wall. The straps themselves as well as extensions thereof can, in combination with the arrangement of the corrugations of the guide wall, constitute means for blocking the otherwise free flow path for the hot gases expected in this region, so as to promote a better heat exchange in this region.

In further accordance with the invention, the individual straight or arcuate guide-wall sections in the U-shaped region of the tubes can be coupled in individually movable manner to each other at their adjacent abutment edges. More particularly, the sections can be connected movably at their ends in chain-like manner or they can be interengaged with one another and thus "ride" individually or in groups, for example, on straps of the tubes.

Instead of the finger-like engagement between the guide wall and the housing, eleongated elements such as ropes, sheet-metal strips or wires can extend from the inlet and outlet of the housing over and between the guide wall structure and thus guidably hold the latter in position from the housing without limiting the necessary mobility.

Therefore, according to the invention, there is provided a simple, flow-favorable limiting guide wall for heat exchangers of the aforementioned type in which each U-shaped tube of the assembly can expand individually in longitudinal direction with respect to the adjacent tubes. The tubes can have a circular cross-section or of another profile which is favorable for flow, for instance, an oblong or lancet-shaped profile. As compared to conventional heat exchanger constructions, there is the advantage that temperature differences, which result from the operation of the heat exchanger or local disturbances in the heat exchanger or from non-steady conditions of operation, cause no internal tensions with high stressing of the structural elements as the differences in expansion are counteracted by relative displacements of the respective elements. Nevertheless, there remains a flow-favorable, homogeneous passage for the heated gases along the U-shaped portions of the tubes so that in this region of the tube assembly, optimum heat exchange can also take place, which contributes to increasing the heat exchange as well as optimizing the cyclic process of an associated internal combustion engine or gas turbine plant. Relatively little kinetic energy is present at the outlet side of the gas flow at the outer periphery of the tube assembly so that the main gas discharge conditions are substantially undisturbed.

The invention will be described hereafter in relation to specific embodiments with reference to the attached drawing.

BRIEF DESCRIPTION OF THE FIGURES OF THE DRAWING

FIG. 16 is a diagrammatic cross-section through a one-piece guide wall according to an embodiment of corrugated U-shape.

FIG. 17 is a diagrammatic cross-section through a one-piece guide wall according to another embodiment of corrugated V-shape.

FIG. 18 is a diagrammatic illustration pf a portion of FIG. 11 showing a chain-link type of connection between segments of the guide wall.

FIG. 19 is a diagrammatic illustration, similar to FIG. 18, of another embodiment of the connection between segments of the guide wall.

DETAILED DESCRIPTION

Figure 1:
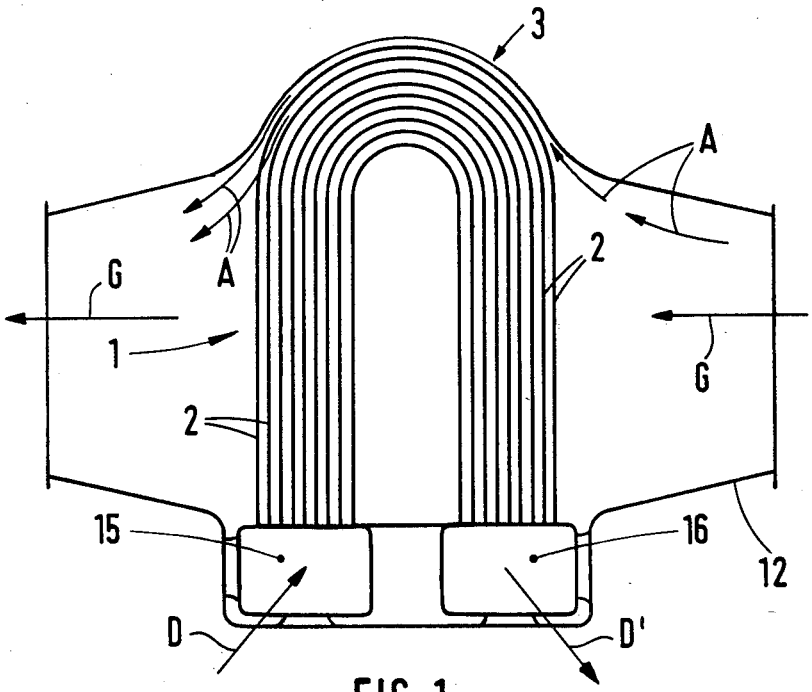
FIG. 1 is a diagrammatic end view of a heat exchanger according to the invention.
Figure 2:
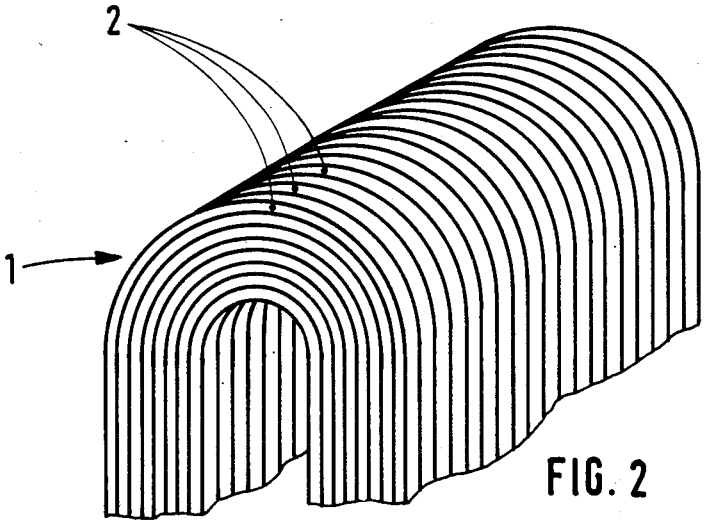
FIG. 2 is a diagrammatic perspective view of the heat exchanger tube assembly in the heat exchanger of FIG. 1.

Referring to FIGS. 1 and 2, therein is seen a heat exchanger which comprises an assembly or matrix 1 of heat exchanger tubes 2 of U-shape which are positioned within a housing 12 such that heated gases G can flow across the tube matrix 1 in the direction of the arrows from an inlet region in the housing on one side of the matrix to an outlet region in the housing on the other side of the matrix.

The U-shape tubes 2 of the matrix 1 have straight legs respectively connected to inlet and outlet ducts 15,16. The ducts 15 and 16 extend substantially parallel to one another in a direction perpendicular to the flow of gases G. The matrix 1 extends transversely along the length of ducts 15 and 16. An operating fluid, such as compressed air, is supplied to the tubes 2 of the matrix at duct 15 and the operating fluid flows through the interior of the tubes and is discharged at duct 16. In the course of travel of the compressed air through the tubes the compressed air is heated by the gases G flowing around the exterior of the tubes so that the compressed air supplied to duct 16 from the tubes 2 is heated.

The U-shaped tubes 2 have curved U-portions connected to the straight legs and the compressed air flowing in the tubes undergoes reversal of direction in the curved U-portions. The curved U-portions of the tubes are surrounded by a limiting guide wall 3 which is connected at its inlet and outlet sides to the housing 12.

Figure 4:
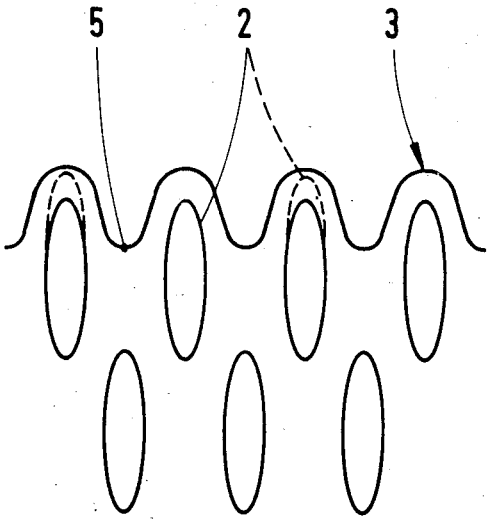
FIG. 4 is a diagrammatic section through a portion of the tube assembly with its surrounding guide wall.

As seen in FIGS. 2 and 4 the tubes 2 of the matrix 1 are arranged in a field in substantially equally spaced interdigitated relation.

The two guide ducts 15,16 can be integrated in a common duct, as in U.S. Pat. No. 3,746,083.

In accordance with the basic concept of the invention, the limiting guide wall 3 conforms in shape to the curved U-portions of the tube matrix 1, and it is mounted in self-supporting relation on several outer tube 2 of the matrix and is connected in sealed fashion to the inlet and outlet of the housing 12 in a resiliently movable, form-locked manner. Consequently, an arcuate flow path is imposed on a portion of hot gas around the limiting guide wall 3 in the direction of arrows A. If the tube matrix extends linearly in the outer region, a corresponding linear flow path would be imposed on the hot gas by the provision of a corresponding linear shape of the limiting guide wall. Accordingly, the limiting guide wall 3 conforms in shape to the direction reversing portions of the tubes 2 of the matrix 1 be they curved as shown or linear (not shown).

The floating direct support of the limiting guide wall 3 prevents the formation of the customary large leakage gap between the limiting guide wall 3 and the curved U-portions of the outer row of tubes and the flow of the hot gas can be rationally included in the heat exchange process of the individual stream A which is split off from the main stream of hot gas G.

Figure 3:
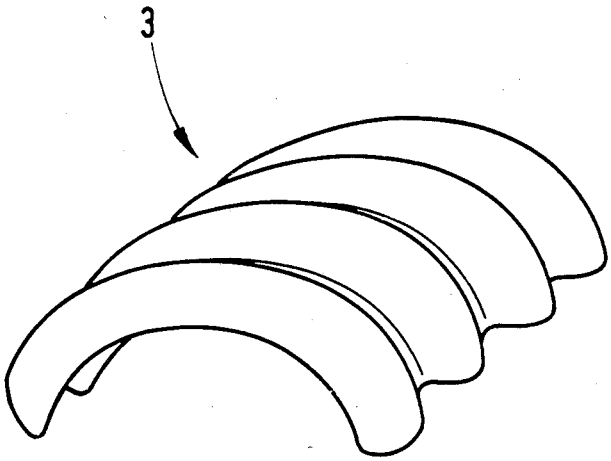
FIG. 3 is a perspective view of a portion of a corrugated guide wall of the heat exchanger.

In FIG. 3, a portion of the limiting guide wall 3 is seen in diagrammatic perspective view, in a one-piece embodiment which is corrugated over its entire length. The wall 3 "rides" on the peaks of the U-shaped portions of the tubes 2, which are of oval cross-section. The wall 3 contacts the U-shaped portions of those tubes 2 connected to ducts 15 and 16 which are most distant from the ducts in operation as a result of thermal expansion, as indicated by the dotted outline of the profiled tubes in FIG. 4. In this regard, the corrugated shape of the limiting guide wall 3 corresponds to the spacing between adjacent tubes, each corrugation peak 5 of the limiting guide wall 3 extending between adjacent tubes 2, as shown in FIG. 4. At its inlet and outlet sides, the limiting guide wall 3 is mounted in form-locked but displaceable manner on adjacent portions of the housing in a manner to be described later with reference to FIGS. 9 and 10.

Figure 5:
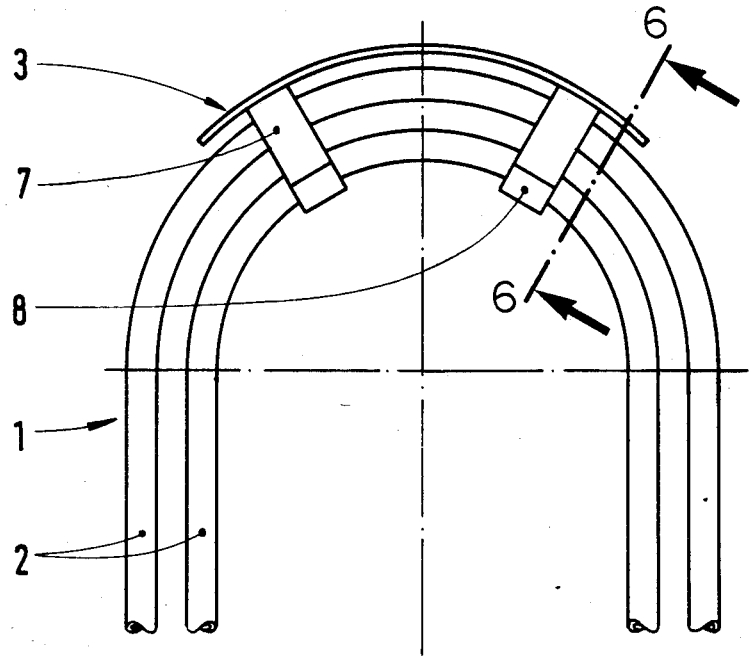
FIG. 5 is an end view, corresponding to FIG. 1, showing on enlarged scale a first embodiment of the mounting of a guide wall on the heat exchanger tubes.

The embodiment shown in FIG. 5 corresponds, in principle, to that described previously, however, instead of profiled tubes of oblong cross-section, the tubes have a circular cross-section. In the U-shaped flow reversal region, spaced straps 7 and 8 are utilized to mount the wall 3 on the tubes 2 in the outer region of the tube matrix. The straps 7 firmly, possibly by welding, surround respective tubes 2 and have inward radial extensions 11, whereas stops 8 have radial extensions 11 which are directed outwardly and thus project towards the corrugated peaks 5 of the limiting guide wall 3. The corrugated limiting guide wall 3 "rides" on the straps 7 and 8 and accordingly is not in direct contact with the tubes 2. Thereby, the tubes are not subjected to any wear and thus the danger of leakage as a result of wear is prevented. The straps 7,8 are shown as being made from a single part. The limiting guide wall 3 rests on a plurality of the straps 7,8.

Figure 7:
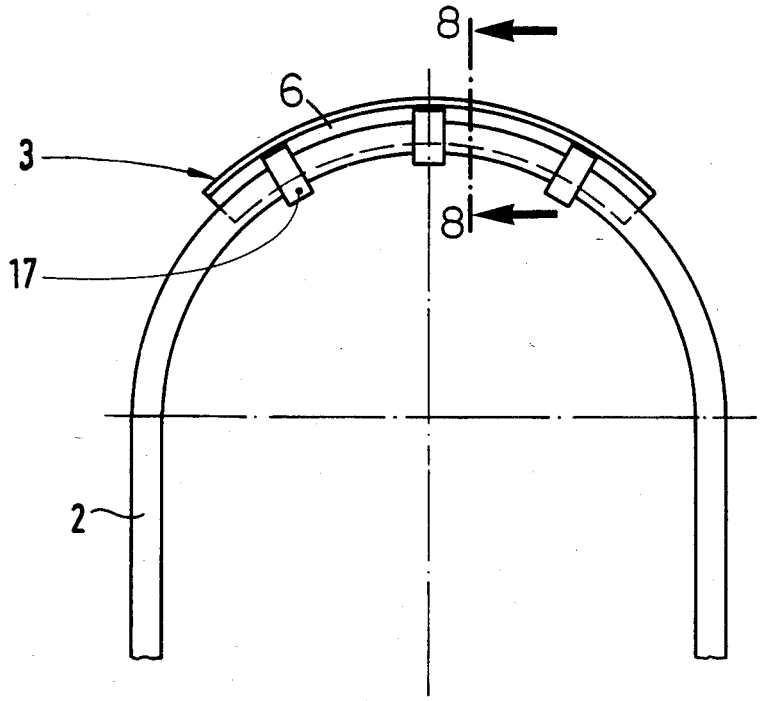
FIG. 7 is an end view, similar to FIG. 5, of another embodiment of the mounting of a guide wall on the heat exchanger tubes.
Figure 8:
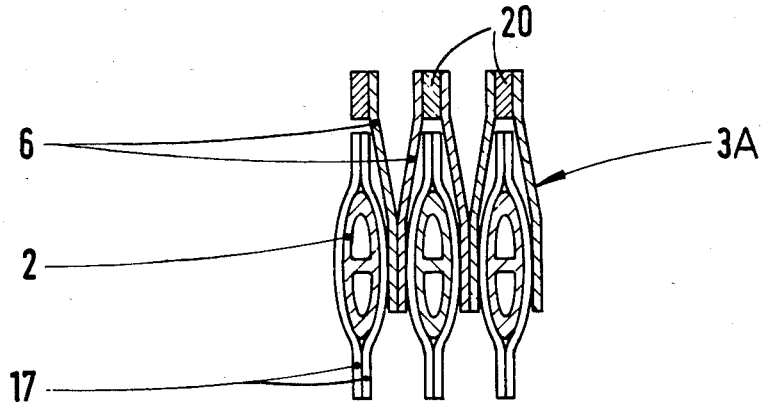
FIG. 8 is a sectional view taken on line 8—8 in FIG. 7.

The embodiment of the heat exchanger shown in FIGS. 7 and 8 has a modified limiting guide wall 3A which is arcuate in shape and comprises individual guide wall sections 6 which are movable relative to each other. The arcuate guide wall sections 6 are each of substantially the same construction and, as seen in FIG. 8, are of flattened S-shape. Consequently, adjoining guide wall sections 6 form a substantially V-shaped opening which widens radially outwards. The guide wall sections of adjoining tubes are interposed between adjacent straps 17 of respective tubes. Each tube 2 is straddled by two guide wall sections 6 which are securely connected to one another at their radially outer ends via a spacer member 20. Each pair of sections 6 "rides" on the straps 17 of the corresponding tube 2. Adjacent pairs of guide wall sections contact each other at a radially inner location and are relatively displaceable thereat to provide relative displaceability between the sections 6. As a result of the contact of the adjacent wall sections, substantial closure of the limiting guide wall 3 is produced, as in the case of the embodiment of FIG. 3.

Figure 9:
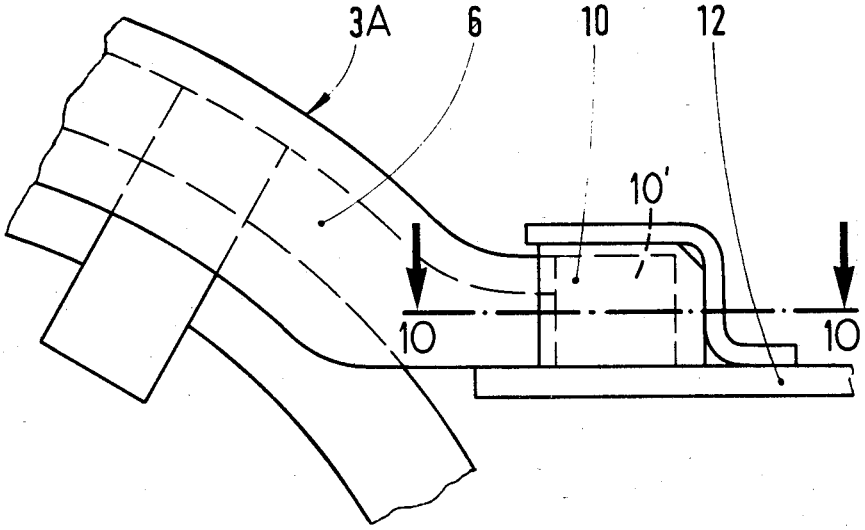
FIG. 9 is an end view, on enlarged scale, showing the connection of the end of the guide wall in FIG. 7 to the housing of the heat exchanger at the inlet end for heated gas.
Figure 10:
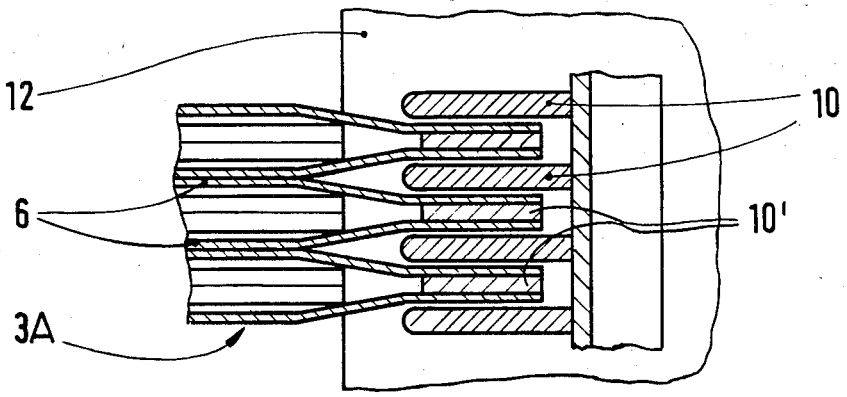
FIG. 10 is a sectional view taken on line 10—10 in FIG. 9.

As seen in FIGS. 9 and 10, at the inlet and outlet ends of the limiting guide wall 3A, the ends of the guide wall sections 6 are formed with end parts 10' which taper in finger-like manner and engage in form-locked but displaceable manner between corresponding finger-like extensions 10 on housing 12. In this way, a "floating" support of the limiting guide wall 3A with housing 12 is obtained.

Figure 6:
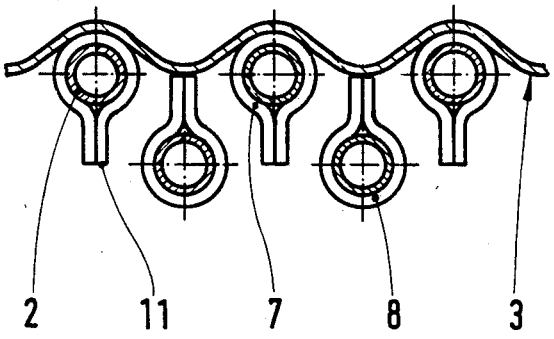
FIG. 6 is a sectional view taken on line 6—6 in FIG. 5.
Figure 11:
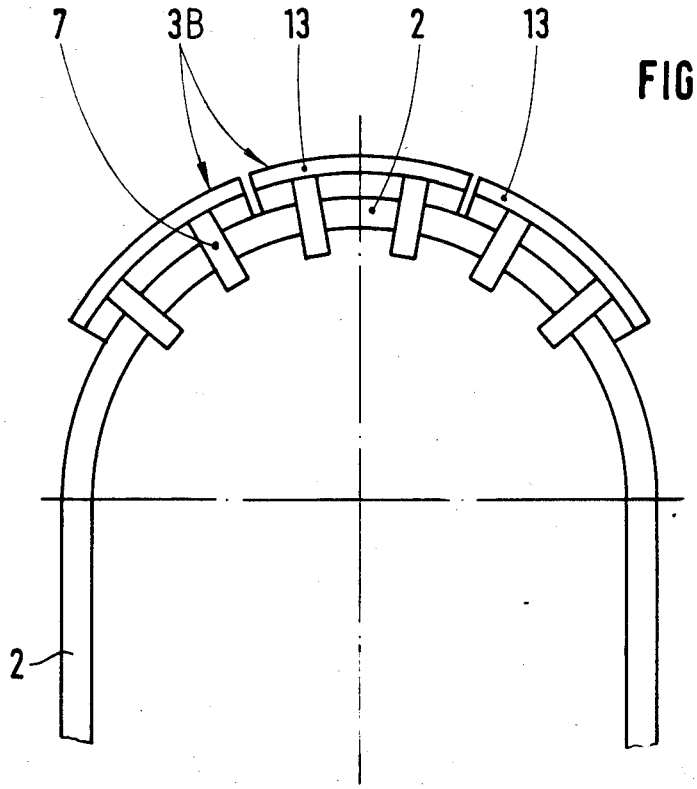
FIG. 11 is an end view, similar to FIG. 7, of another embodiment of the mounting of the guide wall on the heat exchanger tubes.
Figure 12:
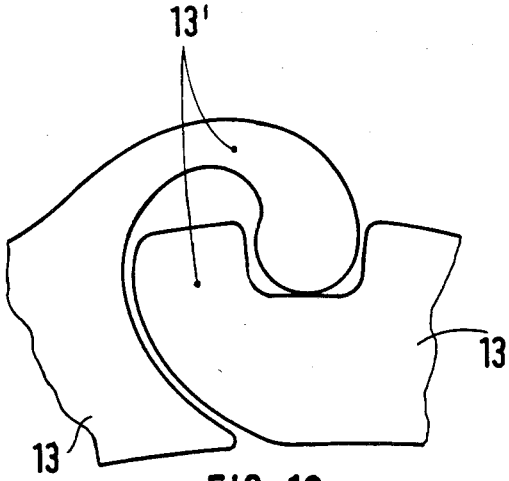
FIG. 12 is a diagrammatic illustration, on enlarged scale, of the connection between segments of the guide wall.
Figure 13:
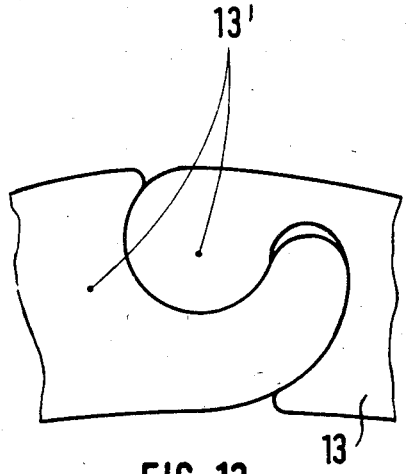
FIG. 13 is similar to FIG. 12 of another embodiment of the connection between segments of the guide wall.

The embodiment shown in FIG. 11 comprises guide wall 3B composed of arcuate segments 13 which "ride" on straps 7 similarly to the embodiment in FIGS. 5 and 6. The segments 13 have adjacent abutting edges which are coupled together for movement relative to one another in form-locked manner as shown in detail in FIGS. 12 and 13. In the installed condition of the guide wall segments 13, end parts 13' which are bent in hook shape, are engaged so that the segments 13 are snap-fit and locked movably with respect to each other. When disassembled, the guide wall segments 13 can be separated from each other by moving them at an angle to each other.

Figure 14:
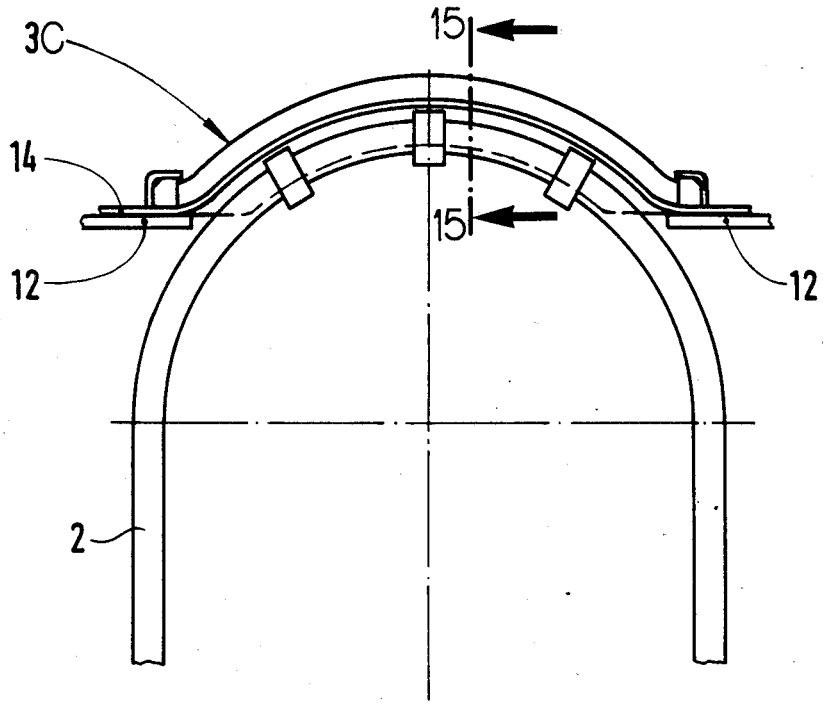
FIG. 14 is an end view, similar to FIG. 11, of another embodiment of the guide wall.
Figure 15:
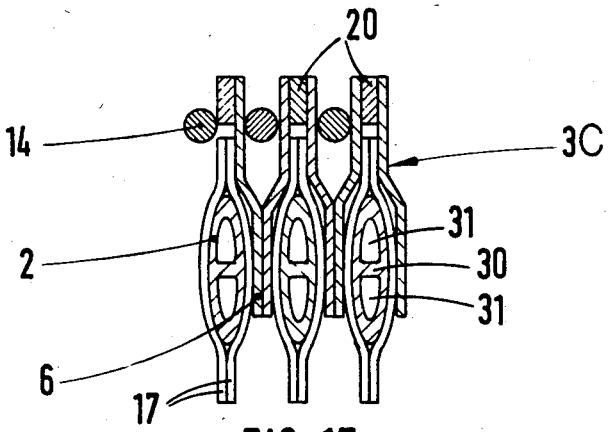
FIG. 15 is a sectional view taken on line 15—15 in FIG. 14.

FIGS. 14 and 15 show another embodiment of a heat exchanger having a limiting guide wall 3C assembled from a plurality of guide wall sections 6 similar to the embodiment shown in FIG. 8. In FIGS. 14 and 15, the limiting guide wall 3C is held together by outer wires 14 which extend in circumferential recesses or corrugation valleys of the limiting guide wall 3C, the wires 14 being secured at their ends to housing 12.

Instead of the wires 14, sheet-metal strips or ropes can be employed. Also, the pairs of guide wall sections 6 for each tube 2 can be displaceable relative to each other and "ride" on the corresponding straps 17. By means of the arrangement of the wires 14, therefore, the limiting guide wall 3C can freely expand radially of the wires 14.

FIG. 16 diagrammatically shows a limiting guide wall 3D which is continuously corrugated in U-shape in longitudinal section, and FIG. 17 shows a limiting guide wall 3E which is continuously corrugaged in V shape in longitudinal section. These corrugated walls could also be constructed from individual wall sections.

FIG. 18 shows a modified embodiment of the connection of two arcuate guide wall segments 13 in FIG. 11. In FIG. 18 the guide wall segments 13A are connected together in the manner of chain-links by links 21 which are pivotably connected by pins 23 within recesses 22 at the ends of the adjoining segments 13A.

FIG. 19 shows another embodiment of the connection of two arcuate guide wall segments 13B. In FIG. 19 there is seen a sheet-metal cover 24 extending radially outwards of segments 13B and over two adjacent segments. The cover 24 has radially inwardly projecting extensions 25 which engage with relatively large play in holes 26 in the ends of the guide wall segments 13B. The extensions include enlarged portions 27 which retain the segments 13B on the extensions 25. A plate 28 is secured on the sheet metal cover 24 and is provided with resilient sealing members 29 which bear against segments 13B and urge the same against the enlarged portions 27. The connection in FIGS. 18 and 19 permits individual displaceability of the guide wall segments 13B.

Referring again to FIG. 15, therein it is seen that the individual tubes 2 are oblong in cross-section to provide an aerodynamically optimized cross-sectional profile, and the tubes are each formed with two compressed-air inner channels 31 separated by a transverse web 30 and adapted in shape to the oblong contour of the tube. Such a profile makes it possible, with relatively small dimensions and comparatively high ridigity, to establish favorable conditions for a high degree of heat exchange.

As seen from the description herein, the invention provides for support of the guide wall, over the opening in the housing through which the U-shaped portions of the tubes of the matrix extend, by resting the guide wall on the outer row of tubes in a floating manner such that the guide wall freely displaces with the tubes as they move due to differential thermal effects, the ends of the guide wall being relatively displaceable with respect to the housing to permit the floating movement. The ends of the guide wall form a substantially fluid-tight closure with the housing, and a heat-exchange fluid can flow in a passage between the guide wall and the tube matrix from an inlet in the housing to an outlet thereof.

Although the invention has been disclosed in relation to a specific embodiment thereof, it will become apparent to those skilled in the art that numerous modifications and variations can be made within the scope and spirit of the invention as defined by the attached claims.

What is claimed is:

1. A heat exchanger comprising an assembly of spaced heat exchanger tubes of U-shaped having inlet ends for receiving an operating fluid, outlet ends for discharge of said fluid and U-shaped portions for flow reversal of said fluid, a housing receiving said tube assembly and including an inlet for a second fluid for flow across said assembly to undergo heat exchange with the fluid flowing in the tubes and an outlet for discharge of the second fluid, said housing having an opening through which said U-shaped portions of said tubes extend for free displacement relative to said housing, a guide wall surrounding said tubes at said U-shaped portions and connected to said housing to cover said opening therein, said guide wall being corrugated lengthwise of said tube assembly and including peaks and valleys, said tubes of said assembly being received within the peaks of said corrugated guide wall, means supporting said corrugated guide wall on said tubes of said assembly in floating relation and means supporting said guide wall, at opposite ends thereof, on said housing for relative movement, the combination of the support of the guide wall in floating relation on the tube assembly and for movement on the housing permitting free movement of said tube assembly relative to said housing and relative movement of said tubes with respect to one another and to said corrugated guide wall.

2. A heat exchanger as claimed in claim 1 wherein said guide wall is curved to conform to the curvature of said U-shaped portions.

3. A heat exchanger as claimed in claim 1 wherein said corrugations are of shape.

4. A heat exchanger as claimed in claim 1 wherein said guide wall comprises a plurality of parallel, adjoining sections which collectively form the extent of the guide wall lengthwise of said tube assembly.

5. A heat exchanger as claimed in claim 4 wherein said adjoining sections of said guide wall are movable relative to one another.

6. A heat exchanger as claimed in claim 1 wherein said tubes of said tube assembly include tubes facing said guide wall, said means supporting said guide wall on said tube assembly in floating relation comprises straps on said U-shaped portions of the tubes in said tube assembly which face said guide wall, said guide wall slidably resting freely on said straps.

7. A heat exchanger as claimed in claim 6 wherein said straps are secured to their respective said tubes and surround the same.

8. A heat exchanger as claimed in claim 7 wherein said straps include radial projections which for alternate tubes extend towards and away from said guide wall.

9. A heat exchanger as claimed in claim 1 wherein said means supporting said guide wall on said housing for relative movement includes, at one end of said guide wall, spaced finger-like projections both on said guide wall and on said housing interengaged with one another to provide relative displacement lengthwise of said projections.

10. A heat exchanger as claimed in claim 1 wherein said guide wall comprises a plurality of segments extending around said U-shaped portions of said tubes and having adjacent abutment edges, and means connecting said segments to provide relative movement therebetween at said abutment edges.

11. A heat exchanger as claimed in claim 10 wherein said means connecting said segments comprises links pivotably connected to adjacent segments to provide a chain-like connection.

12. A heat exchanger as claimed in claim 10 wherein said means connecting said segments comprises interlocked ends of said segments at said abutment edges.

13. A heat exchanger as claimed in claim 10 wherein said means connecting said segments comprises slidable locking means resiliently holding said segments in adjoining relation.

14. A heat exchanger as claimed in claim 1 comprising guide means supported by said housing and extending along said guide wall for guiding the movement of said guide wall.

15. A heat exchanger as claimed in claim 14 wherein said guide means comprises an elongated member having ends secured to said housing and shaped to conform to said guide wall.

16. A heat exchanger as claimed in claim 15 wherein said elongated member comprises a wire element which said guide wall slidably engages.

17. A heat exchanger as claimed in claim 1 wherein said tubes of said tube assembly include tubes facing said guide wall, said means supporting said guide wall on said tube assembly in floating relation comprises straps on said U-shaped portions of the tubes in said tube assembly which face said guide wall, said guide wall slidably resting freely on said straps.

18. A heat exchanger as claimed in claim 17 wherein said guide wall comprises a plurality of parallel, adjoining sections which collectively form the extent of the guide wall lengthwise of said tube assembly, said sections of said guide wall being arranged in pairs each associated with a respective tube facing said guide wall, the sections of each pair straddling the respective tube and slidably engaging the strap thereon, the sections of one pair being in slidable contact with the adjoining sections of the adjacent tubes, the contacting sections of adjacent tubes forming a V-shaped opening which opens radially outwards.

19. A heat exchanger as claimed in claim 1 wherein said tubes have oblong cross-sections for aerodynamic optimization of fluid flow and include a transverse web forming a pair of separate adjacent inner channels.

20. A method of covering a flow reversal region of tubes of a tube assembly in a housing of a heat exchanger to permit free displacement of the tube assembly relative to the housing and of the tubes of the assembly relative to one another, said method comprising:

freely resting a guide wall on the tube assembly in floating relation to cover the flow reversal region of the tubes of the assembly and form a flow passage for a heat exchange fluid between the guide wall and the tube assembly, said guide wall, when resting on the tube assembly, following any movement said tube assembly in floating relation therewith while permitting movement of the tubes relative to one another and to the guide wall, and displaceably supporting the guide wall, at the ends thereof, on the housing to permit the movement of the guide wall with the tube assembly while forming a substantially fluid-tight closure with the housing.

21. A method as claimed in claim 20 wherein the tubes of the tube assembly are arranged in spaced relation and include an outer row facing the guide wall, said guide wall resting on tubes in said outer row.

22. A method as claimed in claim 21 wherein said guide wall slidably rests freely on said tubes.

23. A method as claimed in claim 21 wherein the flow reversal region of the tubes are curved and the guide wall is curved to conform with the curvature of the tubes, said flow reversal region of the tubes protruding through an opening in the housing, said guide wall covering the opening in the housing.

24. A heat exchanger as claimed in claim 1 wherein said corrugations are of V-shape.

25. A heat exchanger as claimed in claim 1 wherein said corrugations are of S-shape.

* * * * *

UNITED STATES PATENT AND TRADEMARK OFFICE

CERTIFICATE OF CORRECTION

PATENT NO. : 4,586,564
DATED : May 6, 1986
INVENTOR(S) : HAGEMEISTER

It is certified that error appears in the above—identified patent and that said Letters Patent is hereby corrected as shown below:

IN THE CLAIMS:

Claim 1, line 2: change "U-shaped" too--U-shape--

Claim 3, line 2: change "shape" too--U-shape--

Signed and Sealed this

*Thirtieth* Day of *September 1986*

[SEAL]

*Attest:*

DONALD J. QUIGG

*Attesting Officer*

*Commissioner of Patents and Trademarks*